United States Patent [19]

Zwart

[11] Patent Number: 4,987,667

[45] Date of Patent: Jan. 29, 1991

[54] METHOD OF DECORATIVE A HUMAN BREAST

[76] Inventor: Hans Zwart, 214 Northview Rd., Dayton, Ohio 45419

[21] Appl. No.: 503,728

[22] Filed: Apr. 3, 1990

Related U.S. Application Data

[63] Continuation of Ser. No. 321,696, Mar. 10, 1989, abandoned.

[51] Int. Cl.[5] ..... B21F 43/00

[52] U.S. Cl. ..... 29/160.6

[58] Field of Search ..... 29/10, 160.6; 128/92; 606/151, 152, 153, 154, 155, 156, 157, 158

[56] References Cited

U.S. PATENT DOCUMENTS

| | | | |
|---|---|---|---|
| 2,524,562 | 10/1950 | Dawburn | 24/27 X |
| 2,849,770 | 4/1957 | Klanchik | 24/27 |
| 3,131,444 | 3/1962 | Manning | 24/27 |
| 3,975,921 | 8/1976 | Pomaski | 63/13 |
| 4,041,931 | 5/1976 | Elliott | 24/27 X |
| 4,099,298 | 7/1978 | Gimenez | 24/27 |
| 4,107,824 | 5/1977 | Lussier | 24/27 |
| 4,625,526 | 12/1986 | Milawski | 63/2 |

FOREIGN PATENT DOCUMENTS

| | | | |
|---|---|---|---|
| 0867537 | 2/1953 | Fed. Rep. of Germany | 24/551 |

*Primary Examiner*—Timothy V. Eley
*Assistant Examiner*—R. Martin
*Attorney, Agent, or Firm*—Jacox & Meckstroth

[57] ABSTRACT

A nipple ring comprising a generally circular ring of a size adapted to fit snugly around a nipple provided with two overlapping ends which may be squeezed together to enlarge the effective circumference of the ring so that it may be placed on the nipple and then when the ends are released the ring will fit securely around the nipple. The ends may be fitted with smaller circular rings from which to hold pendant jewelry.

9 Claims, 1 Drawing Sheet

METHOD OF DECORATIVE A HUMAN BREAST

This is a continuation of application Ser. No. 321,696, filed Mar. 10, 1989, now abandoned.

BACKGROUND OF THE INVENTION

Humans have been decorating their nipples from time immemorial by attaching decorative jewelry thereto. A common way to do this is to pierce the nipples and then insert a thread in the resultant hole. However, few individuals today are willing to undergo such treatment just to wear jewelry. Moreover, there are few facilities where one can have nipples pierced safely. In addition, once the nipple is pierced a retaining device has to be worn at all times, since nipple perforations can heal within 24 hours if left open. Such retaining devices may not be desirable to be worn at certain times. The danger of infection is another serious drawback. Furthermore, if the retaining device is a ring worn in the pierced nipple, it could get caught and it might cause serious harm to the wearer.

U.S. Pat. No. 4,625,526, Milawski, discloses a nipple decoration device which basically is a pressure pad earring shaped and designed so that it will fit over the nipple of the wearer. The device contains springs within the body of the ring which compress two opposing pads that are to be placed around the nipple. All of the references cited in the prosecution of U.S. Pat. No. 4,625,426, Milawski, relate to pressure pad earrings.

The major disadvantage of this approach to a decorative device to be hung from the nipple is the fact that all of these devices rely on opposing pressure pads. The nipple, unlike the earlobe, can change in size and consistency considerably due to temperature, sexual excitation, etc. This can result in the pressure pad type of decorative device becoming loose and being lost and, in addition, would not be comfortable for the wearer.

SUMMARY OF THE INVENTION

The present invention is a nipple ring which is circular in shape and open with two overlapping ends so that when the ends are squeezed together the circumference of the nipple ring is enlarged so that it may be placed conveniently over the nipple and then when the pressure is removed from the two ends the nipple ring will fit snugly around the nipple. The two open ends of the nipple ring are preferably provided with means for attaching decorative jewelry which may hang from the nipple ring. The nipple ring may also be used to have attached thereto a material which will effectively cover the nipple area of the breast or it can be used to hold a material on that portion of the breast so that the nipple and the immediate surrounding area is covered and thus can be used where the law specifies that females cannot expose their breasts. In many jurisdictions, as long as the nipples are not visible, the breasts are not considered to be exposed.

It is therefore an object of this invention to provide a nipple ring which will fit snugly around a human nipple.

It is a further object of this invention to provide such a ring which may be readily positioned around said nipple and may be readily removed from said nipple.

It is still a further object of this invention to provide such a nipple ring which is provided with means to support decorative jewelry items.

These, together with other objects and advantages of the invention will become more readily apparent to those skilled in the art when the following general statements and descriptions are read in the light of the appended drawings.

DETAILED DESCRIPTION OF THE INVENTION

Figure 1:
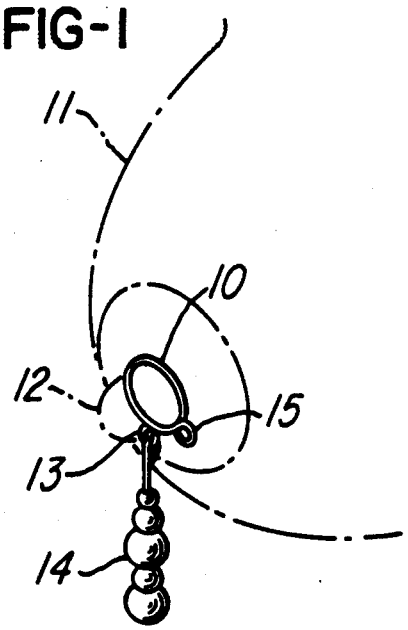
FIG. 1 shows applicant's invention positioned on a nipple shown in phantom with decorative jewelry hanging from one of the smaller rings of applicant's nipple ring.

Referring now to the drawings and more particularly to FIG. 1, applicant's nipple ring 10 is shown positioned on the nipple of a human breast 11 shown in phantom with the human nipple 12 also shown in phantom, showing the nipple ring 10 having a smaller ring 13 from which decorative jewelry 15 is hanging.

Figure 2:
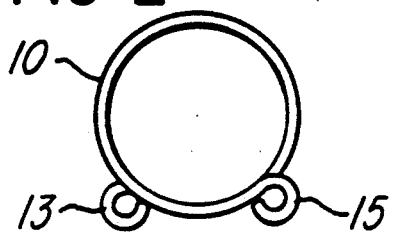
FIG. 2 is a plan view of applicant's invention.
Figure 3:
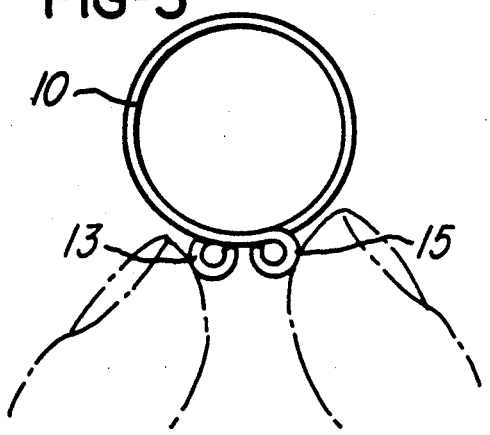
FIG. 3 is a plan view of applicant's invention expanded prior to being placed on the nipple.

Referring now more particularly to FIG. 2, the nipple ring 10 of applicant's invention is shown with the smaller rings 13 and 15 adapted to hold jewelry. In FIG. 3 the smaller rings 13 and 15 are shown squeezed together to enlarge the circumference of the ring 10 so that the ring 10 may be placed over the wearer's nipple 12 and then when the pressure on smaller rings 13 and 15 is released the ring 10 will return to the position shown in FIG. 2 and will fit snugly over the nipple 12.

Figure 4:
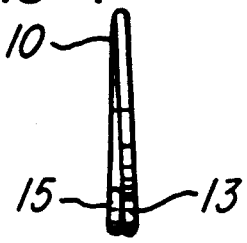
FIG. 4 is a side elevation view of applicant's invention.

Referring now more particularly to FIG. 4, the same nipple ring 10 of FIG. 2 is shown in a side elevation view.

Figure 5:
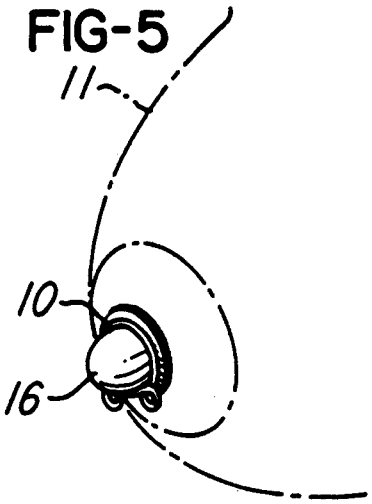
FIG. 5 shows the use of applicant's invention in conjunction with a piece of material which may or may not be attached permanently to the nipple ring to cover the nipple portion of the breast shown in phantom.

Referring now more particularly to FIG. 5, the nipple ring 10 of applicant's invention is shown with a covering material 16, either attached to it or held by it, over the nipple 12 of a human breast 11 shown in phantom.

Figure 6:
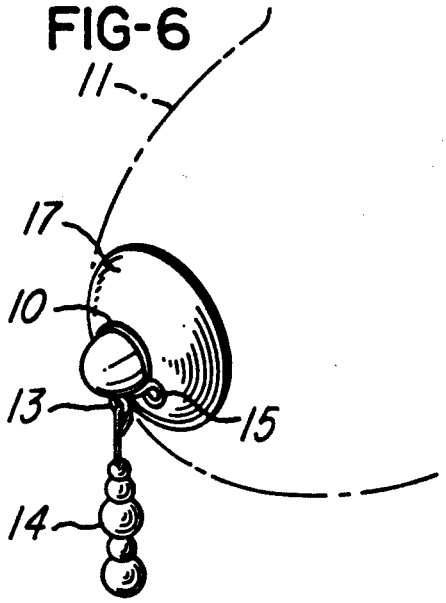
FIG. 6 shows applicant's invention positioned on the nipple over a piece of flexible material, such as cloth, with the cloth covering the nipple and the immediate surrounding area with the breast shown in phantom.

FIG. 6 is similar to FIG. 5 in which a flexible material 17, such as cloth, is held in position over the nipple 12 of the wearer by means of the nipple ring 10 and there is decorative jewelry 14 hanging from smaller ring 13.

In use, the nipple ring is squeezed together by squeezing members 13 and 15 together and the ring 10 is placed over the nipple of the wearer and then the pressure on 13 and 15 is released so that the ring 10 will fit snugly around the nipple of the wearer.

Different sized rings for different sized nipples, of course, are used and the rings may be made of a resilient stainless steel, or silver or gold alloys, or other suitable materials.

In FIG. 5 the covering material 16 may be permanently attached to the nipple ring 10 for use in those areas where female breasts may be exposed except for the nipple itself and likewise in FIG. 6 the flexible material 17 may be either placed over the nipple and held in place by the nipple ring 10 or may be permanently attached thereto. Decorative jewelry such as 14 may be hung from smaller ring 13 or 15 or both. Use of the nipple ring by the wearer obviates the need for piercing the nipple and since the nipple ring 10 completely surrounds the nipple and may be chosen of a size for the particular wearer, will remain on the nipple as the nipple changes in size due to temperature, sexual excitement, etc., which would not be the case in conventional opposing pads of earring-type devices such as disclosed in U.S. Pat. No. 4,625,516, Milawski.

The nipple ring of the present invention provides a simple, efficient, decorative device which may be readily placed on the nipple or removed therefrom, and is safe and convenient to use.

While this invention has been described in its preferred embodiment, it is to be appreciated that variations therefrom may be made without departing from the true scope and spirit of the invention.

What is claimed:

1. A method of decorating a human breast having a projecting nipple, comprising the steps of forming an annular element of spring-like material and including a ring portion having a diameter substantially the same size as the nipple and relatively movable opposite end portions, positioning the end portions to project outwardly from the ring portion, moving the end portions to enlarge the diameter of the ring portion, mounting the enlarged ring portion on the nipple, and releasing the end portions causing the ring portion to grip the nipple around the periphery of the nipple.

2. A method as defined in claim 1 and including the step of attaching a decorative jewelry article to the annular element.

3. A method as defined in claim 1 and including the steps of covering the nipple with a cover member, and attaching the ring to the cover member.

4. A method of decorating a human breast having a projecting nipple, comprising the steps of forming an annular element of spring-like material and including a generally circular ring portion having a diameter substantially the same size as the nipple and relatively movable and overlapping opposite end portions projecting outwardly from the ring portion, pressing the end portions together to enlarge the diameter of the ring portion, mounting the enlarged ring portion on the nipple, and releasing the ned portions causing the ring portion to grip the nipple around the periphery of the nipple.

5. A method as defined in claim 4 wherein the end portions are each formed with a generally circular configuration substantially smaller than the ring portion.

6. A method as defined in claim 4 and including the step of attaching a decorative jewelry article to an end portion of the ring.

7. A method as defined in claim 4 and including the step of mounting a cover material on the nipple, and surrounding the cover material with the ring portion of the element.

8. A method of decorating a human breast having a projecting nipple, comprising the steps of bending a predetermined length of metal wire to form a circular ring portion having a diameter substantially the same size as the nipple and relatively movable and outwardly projecting opposite end portions, moving the end portions to enlarge the diameter of the ring portion, mounting the enlarged ring portion on the nipple, and releasing the end portions causing the ring portion to grip the nipple around the periphery of the nipple.

9. A method as defined in claim 8 and including the step of attaching a decorative jewelry article to the wire ring.

* * * * *